US007262553B2

(12) United States Patent
Brates et al.

(10) Patent No.: US 7,262,553 B2
(45) Date of Patent: Aug. 28, 2007

(54) HIGH EFFICACY METAL HALIDE LAMP WITH CONFIGURED DISCHARGE CHAMBER

(75) Inventors: Nanu Brates, Winchester, MA (US); Shinichi Anami, Wellesley, MA (US); Huiling Zhu, Lexington, MA (US); Stefaan M. Lambrechts, Beverly, MA (US); Jakob Maya, Brookline, MA (US)

(73) Assignees: Matsushita Electric Industrial Co., Ltd., Osaka (JP); Matsushita Electric Works, Ltd., Osaka (JP)

( * ) Notice: Subject to any disclaimer, the term of this patent is extended or adjusted under 35 U.S.C. 154(b) by 216 days.

(21) Appl. No.: 10/607,162

(22) Filed: Jun. 26, 2003

(65) Prior Publication Data

US 2004/0263080 A1 Dec. 30, 2004

(51) Int. Cl.
*H01J 61/33* (2006.01)
*H01J 61/18* (2006.01)

(52) U.S. Cl. ..... 313/634; 313/638; 313/573

(58) Field of Classification Search ..... 313/634, 313/573, 631, 639, 493, 626, 638
See application file for complete search history.

(56) References Cited

U.S. PATENT DOCUMENTS 5,153,482 A * 10/1992 Keijser et al. ..... 313/634
5,936,351 A 8/1999 Lang
5,973,453 A * 10/1999 Van Vliet et al. ..... 313/623
6,137,230 A 10/2000 Born et al.
6,147,453 A 11/2000 Geijtenbeek et al.
6,300,729 B1 10/2001 Keisjer et al.
6,724,144 B2 * 4/2004 Takeji et al. ..... 313/634
6,747,411 B2 * 6/2004 Miyazawa ..... 313/634

FOREIGN PATENT DOCUMENTS

JP 2003086130 A * 3/2003

* cited by examiner

*Primary Examiner*—Karabi Guharay
(74) *Attorney, Agent, or Firm*—Kinney & Lange, P.A.

(57) ABSTRACT

An arc discharge metal halide lamp for use in selected lighting fixtures comprising a discharge chamber having light permeable walls of a selected shape including therein a pair of end region wall portions through each of which a corresponding one of a pair of electrodes are supported separated from one another by a separation length. The ratio of the separation length to the effective operation inner diameter of the chamber is greater than two. The lengths of the wall sides between the end wall portions is greater than the effective operation inner diameter. The end wall portions have inner surfaces of constant or smaller varying radii of curvature and they are separated from the interior ends of the electrodes by more than one millimeter. The discharge chamber can be constructed of polycrystalline alumina and contain metal halides.

22 Claims, 4 Drawing Sheets

HIGH EFFICACY METAL HALIDE LAMP WITH CONFIGURED DISCHARGE CHAMBER

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. Thus, for instance, arc discharge metal halide lamps are being more and more widely used for interior and exterior lighting. Such lamps are well known and include a light-transmissive arc discharge chamber sealed about an enclosed a pair of spaced apart electrodes, and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

These lamps typically have a ceramic material arc discharge chamber that usually contains quantities of metal halides such as $CeI_3$ and NaI, (or $PrI_3$ and NaI) and T1I, as well as mercury to provide an adequate voltage drop or loading between the electrodes and the inert starting gas. Such lamps can have an efficacy as high as 105 LPW at 250 W with a Color Rendering Index (CRI) higher than 60, with Correlated Color Temperature (CCT) between 3000 K and 6000 K at 250 W.

Of course, to further save electric energy in lighting by using more efficient lamps, high intensity arc discharge metal halide lamps with even higher lamp efficacies are needed. The lamp efficacy is affected by the shape of the arc discharge chamber. If the ratio between the distance separating the electrodes in the chamber to the diameter of the chamber is too small such as being less than two, the relative abundance of Na between the arc and the chamber walls leads to a lot of absorption of generated light radiation by such Na due to its absorption lines near the peak values of visible light. On the other hand, if the ratio between the distance separating the electrodes in the chamber to the diameter of the chamber is too great such as being greater than five, initiating an arc discharge in the arc discharge chamber is difficult because of the relatively large breakdown distance between the electrodes. In addition, such lamps perform relatively poorly when oriented vertically during operation in exhibiting severe colors segregation as the different buoyancies of the lamp content constituents cause them to segregate themselves from one another to a considerable degree along the arc length.

Another shape consideration is the avoidance of discontinuities in the chamber inner surface such as the presence of corners in the vicinity of the meeting locations of the chamber ends and the chamber central portion, or overlapping joint walls therebetween of similar thicknesses, which discontinuities, if present, result in "cold spots" in the chamber plasma during lamp operation which lowers vapor pressures in the chamber to thereby reduce radiant flux therefrom. In addition, the chamber ends must be shaped so as to leave sufficient clearance between the walls thereof and the electrodes so that temperatures of the ends does not get so great as to damage the structural integrity of those walls.

Thus, there is a desire for an arc discharge chamber that strongly emits light radiation of good color while being operable by currently used ballast circuits.

BRIEF SUMMARY OF THE INVENTION

The present invention provides an arc discharge metal halide lamp for use in selected lighting fixtures comprising a discharge chamber having light permeable walls of a selected shape bounding a discharge region of a selected volume including therein a pair of end region wall portions through each of which a corresponding one of a pair of electrodes are supported to have interior ends thereof positioned in said discharge region so that they are separated from one another by a separation length. These walls have portions thereof as sides between the end wall portions with corresponding effective joined inner diameters at each of those end wall portions and with an effective operation inner diameter over the separation length in directions substantially perpendicular to the separation length such that a ratio of the separation length to the effective operation inner diameter is greater than two. The lengths of the wall sides between the end wall portions is greater than the effective operation inner diameter. The end wall portions have inner surfaces so that intersections thereof with planes containing centers of the electrodes are smooth with radii of curvature therealong equal to or less than half of the corresponding effective joined inner diameter, and so that they are separated from the interior ends of the electrodes by more than one millimeter. The discharge chamber can be constructed of polycrystalline alumina.

The discharge chamber has ionizable materials provided in the discharge region thereof such as metal halides. These halides can include $CeI_3$, $PrI_3$ and NaI.

DETAILED DESCRIPTION

Figure 1:
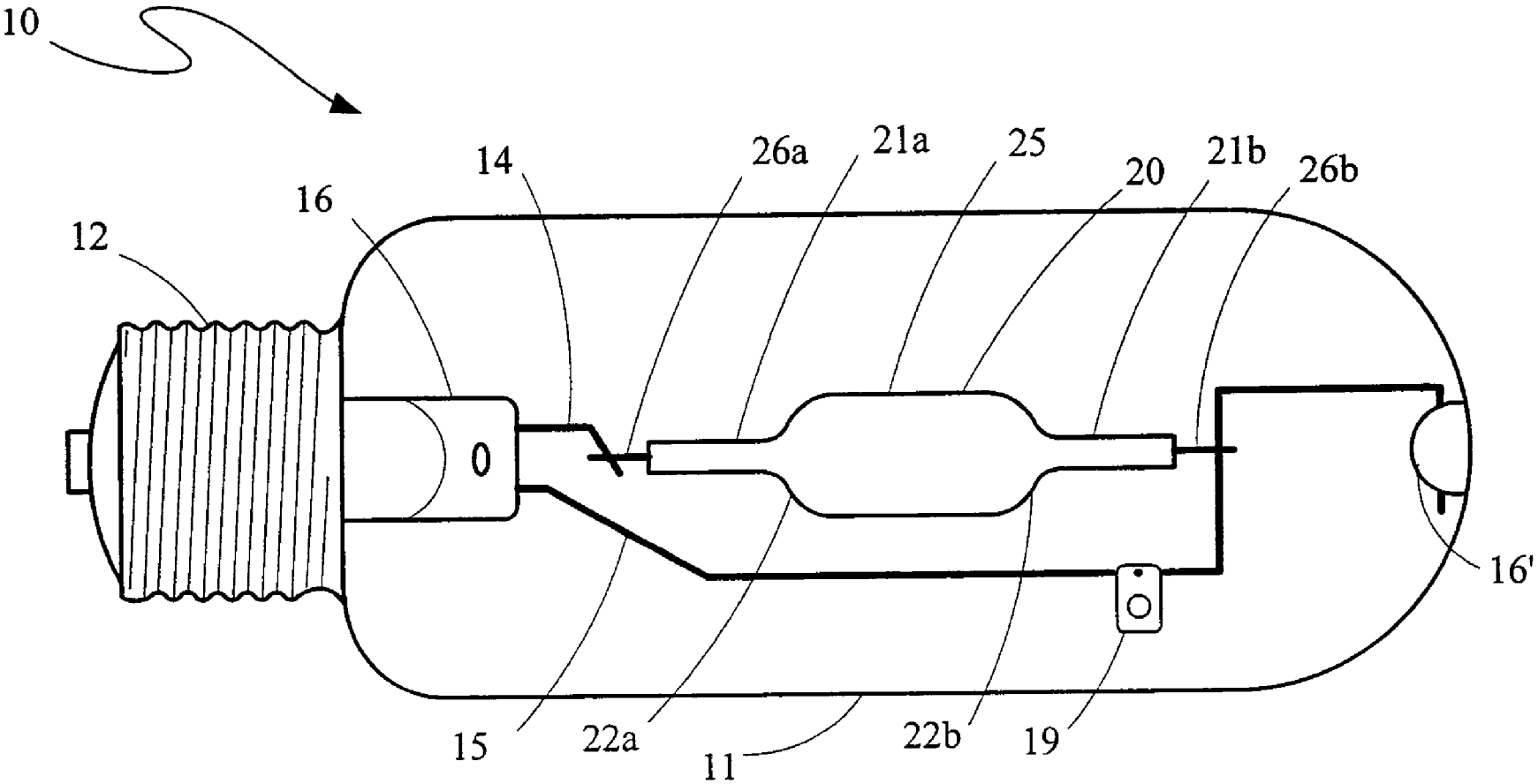
FIG. 1 is a side view, partially in cross section, of an arc discharge metal halide lamp of the present invention having a configuration of a ceramic arc discharge chamber therein.

Referring to FIG. 1, an arc discharge metal halide lamp, 10, is shown in a partial cross section view having a bulbous borosilicate glass envelope, 11, partially cut away in this view, fitted into a conventional Edison-type metal base, 12. Lead-in electrode wires, 14 and 15, of nickel or soft steel each extend from a corresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11. Some remaining portion of each of access wires 14 and 15 in the interior of envelope 11 are bent at obtuse angles away from this initial direction past which bent access wire 14 ends following some further extending thereof to result in it more or less crossing the envelope length axis.

Access wire 15, however, with the first obtuse bend therein past flare 16 directing it away from the envelope length axis, is bent again obtusely to have the next portion thereof extend substantially parallel that axis, and is further bent again at a right angle to have the succeeding portion thereof extend substantially perpendicular to, and more or less cross that axis near the other end of envelope 11 opposite that end thereof fitted into base 12. The portion of wire 15 parallel to the envelope length axis supports a conventional getter, 19, to capture gaseous impurities. A further two right angle bends in wire 15 places a short remaining end portion of that wire below and parallel to the last portion thereof originally described as crossing the envelope length axis which short end portion is finally anchored at this far end of envelope 11 from base 12 in a borosilicate glass dimple, 16'.

Figure 2:
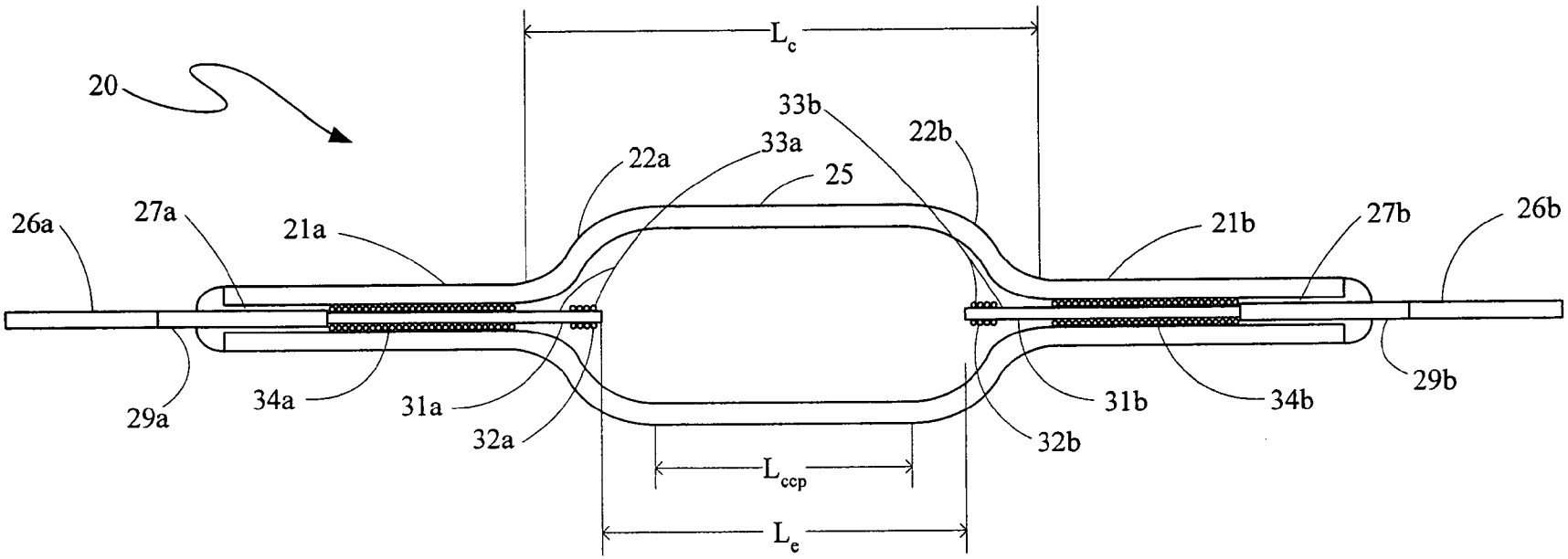
FIG. 2 shows the arc discharge chamber of FIG. 1 in cross section in an expanded view.

A ceramic arc discharge chamber, 20, configured about a contained region as a shell structure having ceramic walls, such as polycrystalline primarily alumina walls, that are translucent to visible light, is shown in one possible configuration in FIG. 1, and in more detail in FIG. 2. Chamber 20 has a pair of small inner and outer diameter ceramic truncated cylindrical shell portions, or tubes, 21*a* and 21*b*, that each flare outward at the interior end thereof into a corresponding one of a pair of rounded shell structure end portions, 22*a* and 22*b*, which smoothly join with a primary central portion chamber shell structure, 25, therebetween in providing corresponding more or less hemispherical shaped shells at opposite ends of chamber 20, except near tubes 21*a* and 21*b*. Thereby, they altogether form a single piece unitary chamber structure about an enclosed interior space without the presence of overlapping wall structures of assembled different parts. Primary central portion chamber structure 25 has a larger diameter truncated cylindrical shell portion between the chamber ends relative to the diameters of tubes 21*a* and 21*b*. Such a structure is formed by compacting alumina powder and sintering the resulting powder compact. Alternatively, the structure 25, ends 22*a* and 22*b*, and tubes 21*a* and 21*b* can be formed separately in the same manner and then joined together at the end surfaces thereof by sintering to again avoid overlapping wall structures.

In the instance of a right truncated cylindrical shaped shell structure for primary central portion chamber structure 25 of chamber 20, the radius of the interior surface of revolution of that truncated cylindrical shell is designated R. In those instances in which shell structure 20 has a different closed wall central portion 25 shape, the average internal radius is also designated R. For ends 22*a* and 22*b* each having a hemispherical shell shape, the radius of the hemispherical interior surface $R_h$ is equal to R in the first instance of a cylindrical shaped shell structure for the primary central portion chamber structure and equal to R±ΔR in the second instance of another closed wall shape where ΔR equals the deviation from the average radius occurring at the ends of primary central portion structure 25 either greater or less than that average. That is, the radius of curvature of the semicircle in its plane formed by the intersection of any plane including the longitudinal axis of symmetry of the interior surface of structure 25 and the interior hemispherical surfaces of either of ends 22*a* and 22*b* is equal to R in the first instance and to R±ΔR in the second instance.

The total length of the enclosed space in chamber 20 extends between the junctures of tubes 21*a* and 21*b* with the corresponding one of ends 22*a* and 22*b*, and is designated $L_c$. The length of primary central portion chamber structure 25 of chamber 20 extends between the junctures therewith and each of ends 22*a* and 22*b* with the designation $L_{ccp}$.

Chamber electrode interconnection wires, 26*a* and 26*b*, of niobium each are axially attached by welding to a corresponding lead-through wire extending out of a corresponding one of tubes 21*a* and 21*b*. Wires 26*a* and 26*b* thereby reach and are attached by welding to, respectively, access wire 14 in the first instance at its end portion crossing the envelope length axis, and to access wire 15 in the second instance at its end portion first past the far end of chamber 20 that was originally described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

FIG. 2 is an expanded cross section view of arc discharge chamber 20 of FIG. 1 showing the discharge region therein contained within its bounding walls that are provided by primary central portion chamber shell structure 25, shell structure end portions 22*a* and 22*b*, and tubes 21*a* and 21*b* extending from ends 22*a* and 22*b*. A glass frit, 27*a*, affixes wire an alumina-molybdenum lead-through wire, 29*a*, to the inner surface of tube 21*a* (and hermetically sealing that interconnection wire opening with wire 29*a* passing therethrough). Thus, wire 29*a*, which can withstand the resulting chemical attack resulting from the forming of a plasma in the main volume of chamber 20 during operation and has a thermal expansion characteristic that relatively closely matches that of tube 21*a* and that of glass frit 27*a*, is connected to one end of interconnection wire 26*a* by welding as indicated above. The other end of lead-through wire 29*a* is connected to one end of a tungsten main electrode shaft, 31*a*, by welding.

In addition, a tungsten electrode coil, 32*a*, is integrated and mounted to the tip portion of the other end of the first main electrode shaft 31*a* by welding, so that electrode 33*a* is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a*, spaced from tube 21*a* by a molybdenum coil, 34*a*, serves to dispose electrode 33*a* at a predetermined position in the region contained in the main volume of arc discharge chamber 20. A typical diameter of interconnection wire 26*a* is 1.2 mm, and a typical diameter of electrode shaft 31*a* is 0.6 mm.

Similarly, in FIG. 2, a glass fit, 27*b*, affixes wire an alumina-molybdenum lead-through wire, 29*b*, to the inner surface of tube 21*b* (and hermetically sealing that interconnection wire opening with wire 29*b* passing therethrough). Thus, wire 29*b*, which can withstand the resulting chemical attack resulting from the forming of a plasma in the main volume of chamber 20 during operation and has a thermal expansion characteristic that relatively closely matches that of tube 21*b* and that of glass fit 27*b*, is connected to one end of interconnection wire 26*b* by welding as indicated above. The other end of lead-through wire 29*b* is connected to one end of a tungsten main electrode shaft, 31*b*, by welding. A tungsten electrode coil, 32*b*, is integrated and mounted to the tip portion of the other end of the first main electrode shaft 31*b* by welding, so that electrode 33*b* is configured by main electrode shaft 31*b* and electrode coil 32*b*. Lead-through wire 29*b* spaced from tube 21*b* by a molybdenum coil, 34*b*, serves to dispose electrode 33*b* at a predetermined position in the region contained in the main volume of arc discharge chamber 20. A typical diameter of interconnection wire 26*b* is also 1.2 mm, and a typical diameter of electrode shaft 31 is again 0.6 mm. The distance between electrodes 33*a* and 33*b* is designated $L_e$, and any plane including the longitudinal axis of symmetry of the interior surface of structure 25 passes through the longitudinal centers of these electrodes.

Configurations of arc discharge chamber 20 that have discontinuities in the interior surface thereof, such as those which result from corners which typically occur near or in the ends thereof, generally have greater amounts of structural wall material present in the vicinity of such discontinuities than occurs at locations along a smooth wall. Thus, ends which are formed as circular disks joined to primary central portion chamber structure 25 so that the ends are flat form right angle corners about the periphery of the disks join where they join with structure 25 and about the interior opening of those disks where they join with tubes 21*a* and 21*b*. Corners, although with more obtuse angles, are formed at these same locations if, rather than disks, truncated cones are use for the ends to provide a tapered ends each extending between primary central portion chamber structure 25 and corresponding ones of tubes 21*a* and 21*b*. The additional wall structure material in the vicinity of such corners leads to an increased heat loss in such regions which reduces the temperature in that vicinity to thereby result in one or more "cold spots" around such locations. Chamber 20, with smooth walls for tubes 21*a* and 21*b*, ends structures 22*a* and 22*b*, and central portion structure 25 formed in a unitary single piece structure, avoids such results. Of course, if this structure is formed from a separate central body portion and separate ends and tubes portions that are assembled with portions of one within another rather than as a smooth walled, single piece unitary structure, overlapping wall structures are formed at the piece part joints with considerable added wall material present at the locations of those overlapping walls and corresponding "cold spots".

Such cold spots are detrimental to the operation of such arc discharge chambers. This is because the vapor pressures of the constituents contained within the chamber depend directly on the cold spot temperatures, and reduced vapor pressures because of "cold spots" reduces the amount of metal halide salts materials participating in arc discharges occurring within the chamber and thus available to emit radiation. Hence, eliminating such cold spots, or at least effectively raising the temperatures of the chamber cold spots by reducing the rate of heat loss in the chamber cold spot locations, through using chambers with only smoothly shaped, untapped wall shell structures to avoid providing locations with greater local volume densities of wall structure materials increases lamp efficacy.

In addition, the rounded end structure 22*a* and 22*b* have to each accommodate an electrode therein or thereby in such a manner that the heat developed in the electrode during operation does not damage these end structures. Avoiding such damage requires that the temperature of rounded shell structure end portions 22*a* and 22*b* should be below approximately 1250° C. Since electrodes 33*a* and 33*b* normally operate at about 2300° C. to 2500° C. at the ends thereof furthest into the enclosed space of chamber 20, this end structure wall temperature requirement necessitates keeping the interior ends of electrodes 33*a* and 33*b* at least some minimum distance away from the walls of the corresponding one of rounded shell structure end portions 22*a* and 22*b* even though being typically positioned therein. Such separation distances being less than 1 mm results in the wall temperature becoming excessive leading to chamber 20 shell structure walls tending to crack. Therefore, a practical minimum separation distance of about 1 mm or greater must be maintained which in turn leads to a limitation on the hemispherical radius of ends 22*a* and 22*b* of $R_h$>1 mm as providing an acceptably long life for chamber 20 and so lamp 10.

Figure 3:
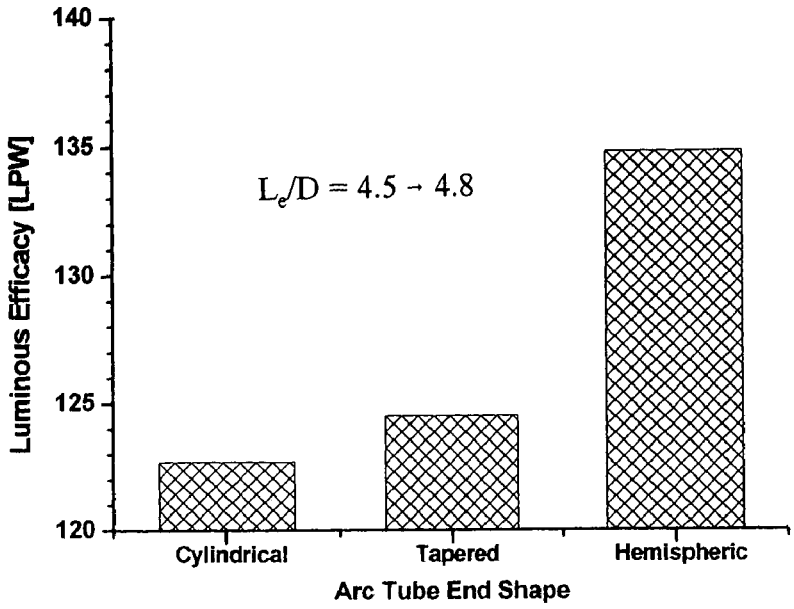
FIG. 3 is a graph showing a bar chart of lamp efficacy (LPW) versus arc discharge chamber shapes.

The bar chart shown in FIG. 3 indicates the relative lamp efficacy improvement achieved for the use of smoothly rounded hemispherical shaped end shell structures for arc discharge chambers as compared to chambers using tapered or flat disk chamber ends. These chambers represented in this chart all have about the same selected ratio of electrode separation distance $L_e$ to primary central portion chamber structure interior surface diameter 2R, this selected ratio being in the range of 4.5 to 4.8. Corresponding data are provided in the following table.

| End Shape | $L_e$/D | Chemical Composition | Molar Ratio RE:NaI Range | Salt Dose Range [mg] | Mercury Dose Range [mg] | Buffer Gas | Pressure [mbar] | Lamp Power [W] |
|---|---|---|---|---|---|---|---|---|
| Cylindric | 4.5 | $CeI_3$—NaI | 10-14 | 10-15 | 1.4-2.5 | Xe | 260 | 250 |
| Taper | 4.8 | $CeI_3$—NaI | 10-13 | 10-18 | 2-3.4 | Xe | 260 | 250 |
| Hemispheric | 4.8 | $CeI_3$—NaI | 10-14 | 8-15 | 1.4-5.1 | Xe | 260 | 250 |

Figure 4:
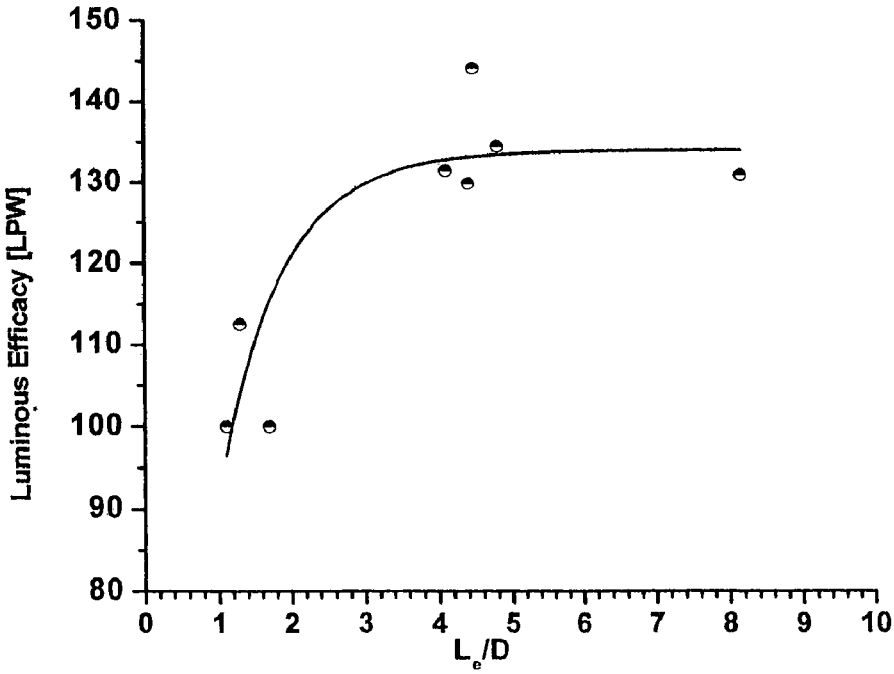
FIG. 4 is a graph showing a plot of lamp efficacy (LPW) versus ratios of arc discharge chamber electrode separation length to effective diameter for a typical lamp of the present invention.

FIG. 4 is a graph showing a plot of lamp efficacy versus the ratio of electrode separation distance $L_e$ to primary central portion chamber structure interior surface diameter for a lamp with a chamber having smoothly rounded hemispherical shaped end shell structures. Clearly from this graph, lamp efficacy drops rapidly for $L_e$/2R ratios decreasing below four and shows little improvement $L_e$/2R ratios increasing above five. However, increasing the $L_e$/2R ratio beyond five has a detriment in that greater values of electrode separation distance $L_e$ require corresponding greater voltages be externally generated and applied between the arc discharge chamber electrodes to initiate voltage breakdown across a path therebetween of the active materials provided in that chamber to there by begin light producing arc discharges.

Lamps in configurations consonant with the foregoing description exhibit luminous efficacies as high as 140 lumens per Watt (LPW) at 150 W dissipation, and as high as 145 LPW at 250 W with, in this latter instance, a Color Rendering Index (CRI) higher than 60, and a Correlated Color Temperature (CCT) between 3000 K and 6000 K. Such lamps are made with metal halides as ionizable materials in the arc discharge chamber including $CeI_3$ and NaI in a rare earth to sodium molar ratio of between 5 and 20, sometimes along with other metal halides or, instead, $PrI_3$ and NaI in a rare earth to sodium molar ratio again of between 5 and 20, and again sometimes along with other metal halides. Xenon is also provided in the chamber as the breakdown initiation starting gas as is mercury to provide an adequate voltage drop or loading between the electrodes.

As an example, one realization of such smooth walled rounded end structure lamp is one with an arc discharge chamber made from polycrystalline alumina having hemispherical shaped end structures and a rated lamp power of 250 W. The overall length $L_c$ of the arc discharge chamber enclosed space is about 34 mm, the electrode tip separating $L_e$ (which sets the length of the discharge arc) is about 29 mmm, and the inner surface diameter D (=2R) of the primary central portion chamber structure is about 7 mm so that $L_e/D=4.1$ or $L_e/D>2$. The quantities of active materials provided in the discharge region contained within the arc discharge chamber were 5.6 mg Hg and 15 mg of the metal halides $CeI_3$ and NaI in a molar ratio of 1:10.5. In addition, there was also provided therein Xe with a pressure of 260 mbar at room temperature to serve as an ignition gas. This lamp has a luminous efficacy of 144 LPW when operating with the longitudinal axis of symmetry of the interior surface of the primary central portion chamber structure in a horizontal position. The light radiated by the lamp had values for CCT and for CRI of 3780K and 71, respectively.

In an alternative example, the lamp has an arc discharge chamber of the same material and general shape with a rated power of 250 W, and with an overall length $L_c$ for the enclosed space of about 34 mm, an electrode tip separating $L_e$ (which sets the length of the discharge arc) that is about 32 mmm, and an inner surface diameter D (=2R) of the primary central portion chamber structure that is about 7 mm so that $L_e/D=4.6$ or again $L_e/D>2$. Here, the quantities of active materials provided in the discharge region contained within the arc discharge chamber were 4.0 mg Hg and 15 mg of $CeI_3$ and NaI in a molar ratio of 1:11.4. Again, Xe was provided therein with a pressure of 260 mbar to serve as an ignition gas. The lamp had a luminous efficacy of 140 LPW, a CCT of 3150, and a CRI of 56.

In another example, the lamp has an arc discharge chamber of the same material and general shape with a rated lamp power of 150 W. The overall length $L_c$ of the arc discharge chamber enclosed space is about 27.5 mm, the electrode tip separating $L_e$ (which sets the length of the discharge arc) is about 25 mmm, and the inner surface diameter D (=2R) of the primary central portion chamber structure is about 5.2 mm so that $L_e/D=4.8$ or once again $L_e/D>2$. The quantities of active materials provided in the discharge region contained within the arc discharge chamber were 1.8 mg Hg and 10 mg of $CeI_3$ and NaI in a molar ratio of 1:19.7. Xe as an ignition gas was provided therein with a pressure of 260 mbar. The lamp had a luminous efficacy of 140 LPW, a CCT of about 3400, and a CRI of 64.

Figure 5:
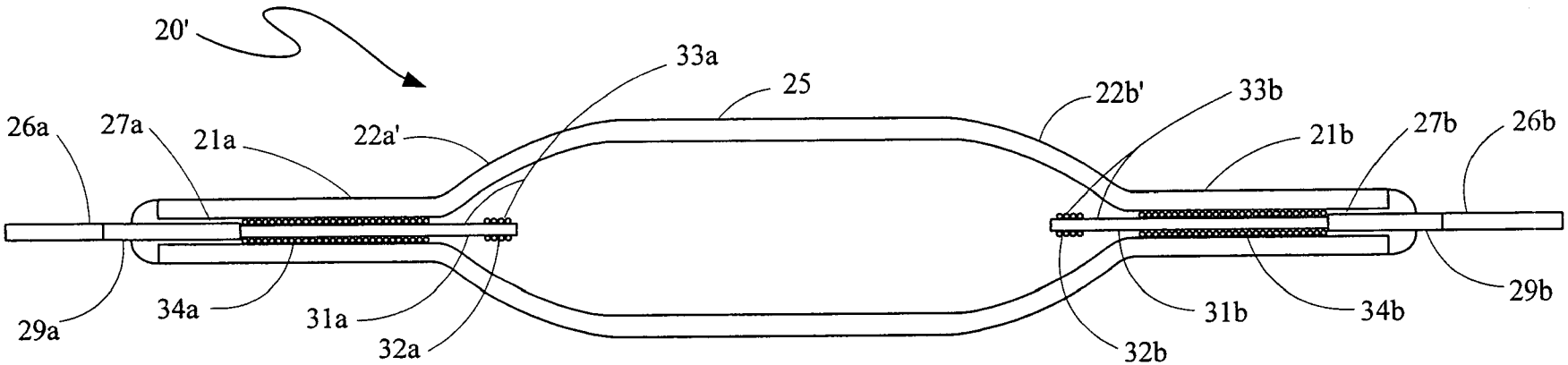
FIG. 5 shows an alternative arc discharge chamber for the lamp of FIG. 1 in cross section in an expanded view.

Alternative to ends shell structures 22*a* and 22*b* being smoothly rounded in having the inner and outer surfaces thereof following hemispherical shapes so that a semicircle is formed by the intersection of any plane including the longitudinal axis of symmetry of the interior surface of the primary central portion chamber structure 25 and the interior hemispherical surfaces of either of these ends, rounded ends can be alternatively provided using end shell interior surfaces of other shapes. One such alternative is shown for smooth walled single piece unitary arc discharge chamber 20' in FIG. 5 of the same material used for chamber 20 above in which the interior and exterior surfaces each of such end shell structures 22*a*' and 22*b*' are a paraboloid of revolution, except near tubes 21*a* and 21*b*. The radius of the interior surface thereof at the open ends of structures 22*a*' and 22*b*' is either equal to R for a cylindrical central portion 25 or to R±ΔR for a different, symmetrical closed wall shape for structure 25.

Thus, a truncated parabola with the sides thereof at the plane of truncation being separated by 2R (or R±ΔR for closed wall shapes different than cylindrical for central shell structure 25 though symmetrical) is formed by the intersection of any plane including the longitudinal axis of symmetry of the interior surface of the primary central portion chamber structure and the interior (and exterior though of a greater truncation plane separation) paraboloidal surfaces of either of these ends. Hence, the radius of curvature of such a parabolic curve in such an intersecting plane is as great as R (or R±ΔR for closed wall shapes different than cylindrical for central shell structure 25) but is less than R (or R±ΔR) at points on such a smooth, continuous curve closer to the closed end of the curve (ignoring the intersections of tubes 21*a* and 21*b*). Arc discharge chamber 20' removes more highly curved portions of end shell structures 22*a*' and 22*b*' further away from the corresponding one of electrodes 33*a* and 33*b*.

Although the present invention has been described with reference to preferred embodiments, workers skilled in the art will recognize that changes may be made in form and detail without departing from the spirit and scope of the invention.

The invention claimed is:

1. An arc discharge metal halide lamp for use in selected lighting fixtures, said lamp comprising:

a discharge chamber having light permeable walls and tubes of a unitary single piece structure that is free of overlapping wall structures between said walls and said tubes and being of a selected shape bounding a discharge region of a selected volume, wherein each of said tubes flares outward at an interior end thereof into a corresponding one of a pair of end region wall portions and each of said tubes at an exterior end thereof is connected to a corresponding one of a pair of frits through each of which a corresponding one of a pair of electrodes is affixed so that said one of the pair of electrodes is supported in a corresponding one of said tubes to have interior ends thereof positioned in said discharge region so that they are separated from one another along a common axis by a separation length, said walls having portions thereof as wall sides between said end region wall portions with said wall sides having an effective joined inner diameter at each end thereof adjacent to a corresponding one of said end region wall portions and having an effective operation inner diameter over said separation length in directions substantially perpendicular to said separation length such that a ratio of said separation length to said effective operation inner diameter is greater than two and with lengths of said wall sides between said end region wall portions being greater than said effective operation inner diameter, said end region wall portions having inner and outer surfaces so that intersections thereof with planes containing said common axis are smooth and so that said end region wall portions are separated from said interior ends of said electrodes by more than one millimeter; and ionizable materials provided in said discharge region of said discharge chamber, wherein said walls, said end region wall portions, said tubes, and said frits bound and hermetically seal the discharge region, and the outer perimeters of said walls, said end region wall portions, said tubes, and said frits smoothly and continuously join together to avoid discontinuous, overlapping wall structures.

2. The device of claim 1 wherein said discharge chamber is formed of walls comprising polycrystalline alumina.

3. The device of claim 1 wherein said ratio of said separation length to said effective operation inner diameter is less than five.

4. The device of claim 1 wherein said ratio of said separation length to said effective operation inner diameter is greater than three but less than five.

5. The device of claim 1 wherein said ratio of said separation length to said effective operation inner diameter is greater than four but less than five.

6. The device of claim 1 wherein said ratio of said separation length to said effective operation inner diameter is greater than five.

7. The device of claim 1 wherein said ionizable materials include metal halides.

8. The device of claim 7 wherein said ionizable materials include $CeI_3$.

9. The device of claim 8 wherein said ionizable materials further include NaI.

10. The device of claim 7 wherein said ionizable materials include $PrI_3$.

11. The device of claim 10 wherein said ionizable materials further include NaI.

12. An arc discharge metal halide lamp for use in selected lighting fixtures, said lamp comprising:

a discharge chamber having light permeable walls and tubes of a unitary single piece structure that is free of overlapping wall structures between said walls and said tubes and being of a selected shape bounding a discharge region of a selected volume, wherein each of said tubes flares outward at an interior end thereof into a corresponding one of a pair of hemispherical shape end region wall portions and each of said tubes at an exterior end thereof is connected to a corresponding one of a pair of frits through each of which a corresponding one of a pair of electrodes is affixed to that said one of the pair of electrodes is supported in corresponding one of said tubes to have interior ends thereof positioned in said discharge region so that they are separated from one another along a common axis by a separation length, said walls having portions thereof as wall sides between said end region wall portions with an interior surface forming a truncated right cylinder having an inner diameter over said separation length in directions substantially perpendicular to said separation length such that a ratio of said separation length to said inner diameter is greater than two and with lengths of said wall sides between said end region wall portions being greater than said inner diameter, said end region wall portions each having inner surfaces having a radius equal to half of said inner diameter which are separated from said interior ends of said electrodes by more than one millimeter; and ionizable materials provided in said discharge region of said discharge chamber, wherein said walls, said end region wall portions, said tubes, and said frits bound and hermetically seal the discharge region, and the outer perimeters of said walls, said end region wall portions, said tubes, and said flits smoothly and continuously join together to avoid discontinuous, overlapping wall structures.

13. The device of claim 12 wherein said discharge chamber is formed of walls comprising polycrystalline alumina.

14. The device of claim 12 wherein said ratio of said separation length to said effective operation inner diameter is less than five.

15. The device of claim 12 wherein said ratio of said separation length to said effective operation inner diameter is greater than three but less than five.

16. The device of claim 12 wherein said ratio of said separation length to said effective operation inner diameter is greater than four but less than five.

17. The device of claim 12 wherein said ratio of said separation length to said effective operation inner diameter is greater than five.

18. The device of claim 12 wherein said ionizable materials include metal halides.

19. The device of claim 18 wherein said ionizable materials include $CeI_3$.

20. The device of claim 18 wherein said ionizable materials include $PrI_3$.

21. The device of claim 19 wherein said ionizable materials further include NaI.

22. The device of claim 20 wherein said ionizable materials further include NaI.

* * * * *

UNITED STATES PATENT AND TRADEMARK OFFICE

CERTIFICATE OF CORRECTION

PATENT NO. : 7,262,553 B2
APPLICATION NO. : 10/607162
DATED : August 28, 2007
INVENTOR(S) : Nanu Brates et al.

It is certified that error appears in the above-identified patent and that said Letters Patent is hereby corrected as shown below:

Column 9, Line 24, delete "9." and insert --10.--

Column 9, Line 26, delete "10." and insert --9.--

Column 9, Line 28, delete "10" and insert --9--

Signed and Sealed this

Eighth Day of July, 2008

JON W. DUDAS
*Director of the United States Patent and Trademark Office*